United States Patent [19]

Grossfield

[11] Patent Number: 4,762,365

[45] Date of Patent: Aug. 9, 1988

[54] CHAIR HAVING A BASE CONFIGURATION ENABLING SELECTIVE ENABLING STATIC OR MOBIL USE

[75] Inventor: Karl Grossfield, London, England

[73] Assignee: Hartana Developments Limited, London, England

[21] Appl. No.: 25,080

[22] Filed: Mar. 12, 1987

[30] Foreign Application Priority Data

Mar. 12, 1986 [GB] United Kingdom ..... 8606177

[51] Int. Cl.[4] ..... A47C 15/00

[52] U.S. Cl. ..... 297/325; 297/DIG. 4; 297/130

[58] Field of Search ..... 297/130, 310, 325, DIG. 4

[56] References Cited

U.S. PATENT DOCUMENTS

| | | | |
|---|---|---|---|
| 1,303,994 | 5/1919 | Ulmann | 297/325 |
| 1,913,295 | 6/1933 | Schreck . | |
| 1,983,206 | 12/1934 | Witzel | 297/325 X |
| 2,065,233 | 12/1936 | Mallett | 297/325 X |
| 2,113,346 | 4/1938 | Heath | 297/325 X |
| 2,354,845 | 8/1944 | Thornton | 297/DIG. 4 |
| 2,700,573 | 1/1955 | Nordgard . | |
| 2,719,572 | 10/1955 | Goldberg | 297/DIG. 4 |
| 2,722,967 | 11/1955 | Reinholz | 297/325 X |
| 3,259,432 | 7/1966 | Jackson | 297/DIG. 4 |
| 4,098,521 | 7/1978 | Ferguson et al. | 297/DIG. 4 |

FOREIGN PATENT DOCUMENTS

| | | |
|---|---|---|
| 317625 | 5/1902 | France . |
| 880333 | 12/1942 | France . |
| 1238905 | 7/1960 | France . |
| 880773 | 10/1961 | United Kingdom . |

*Primary Examiner*—Francis K. Zugel

*Attorney, Agent, or Firm*—Cushman, Darby & Cushman

[57] ABSTRACT

A chair comprising a seat (12,19) having an upstanding backrest (11,20) and a depending leg structure (13,14), with the leg structure terminating in front and rear friction-producing formations (17,18) normally engaged with the ground in a stable disposition for the chair, and the chair additionally having a roller assembly (22,23) in a configuration which extends rearwardly of and across the chair, and which is elevated from the ground with a front-to-rear upward inclination in the normal disposition, whereby the chair can adopt a stable mobile disposition by rearward tilting to engage the roller elements with the ground.

7 Claims, 1 Drawing Sheet

CHAIR HAVING A BASE CONFIGURATION ENABLING SELECTIVE ENABLING STATIC OR MOBIL USE

This invention concerns chairs and more particularly chairs suitable for evacuating disabled persons in the event of fire or other emergency.

Emergencies requiring evacuation from institutions or other environments catering for disabled persons are rare. Nevertheless institutions are required to provide for such an emergency otherwise the difficulties of evacuation can result in unnecessary loss of life. However, space in such institutions is often subject to everyday demands which make it difficult to store special-purpose evacuation equipment at a location sufficiently accessible for ready use of the equipment in an emergency.

One attractive possibility for meeting this difficulty is to modify or design items of furniture or the like to serve a normal everyday use and also, in emergency, as evacuation equipment. This possibility has been pursued, particularly for hospital usage, in relation to mattresses and sheets, but such items do not suit all circumstances for disabled persons.

The present invention also results from pursuing this possibility and provides a chair comprising a seat having a backrest structure and a leg structure respectively upstanding and depending therefrom, said leg structure terminating at its lower end in front and rear friction-producing formations, and said chair normally adopting in use a stable disposition with said formations in ground engagement, characterised by an assembly of at least two roller elements in a configuration which extends both transversely and rearwardly of the chair behind said rear formations, and is elevated relative to said formations, with a front-to-rear upward inclination in said normal disposition, whereby said chair can in use adopt a stable mobile disposition supported only by said roller elements and attained by rearward tilting from said normal disposition.

A principal benefit of the proposed chair is that it can, in large part, take a conventional form suited to normal usage, while having a capability, when occupied, for almost instant redisposition as a wheeled conveyance. Also, this redisposition need not, because of occupancy of the chair, require undue strength or effort on the part of an actuating attendant because the associated tilting can be effected by the application of manual force with mechanical advantage at the upper part of the backrest. Moreover, the stability of the mobile disposition means that no effort need be expended by an attendant simply to sustain this disposition.

Figure 1:
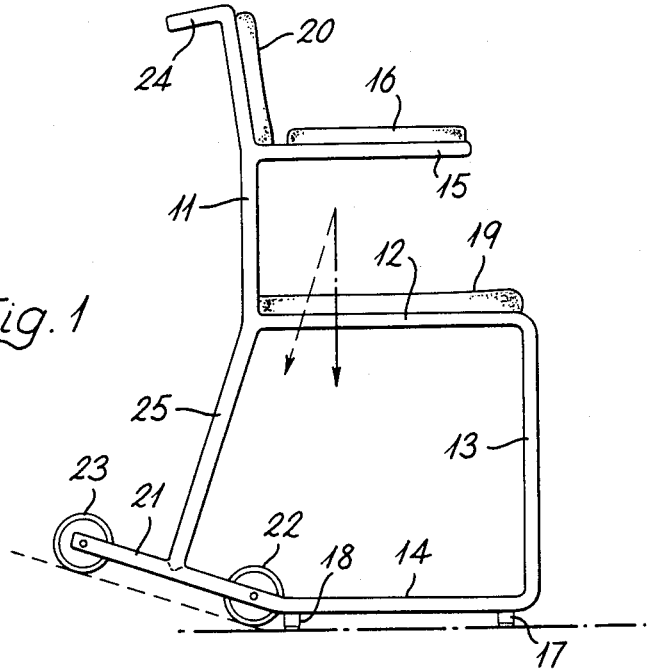
Figure 2:
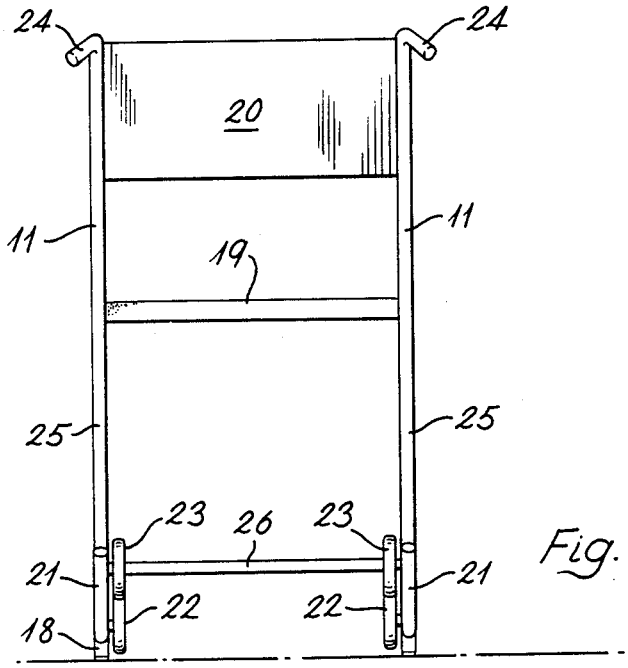

In order that the invention may be more fully understood, a presently preferred form thereof is described below, by way of example, with reference to the accompanying drawings, in which:

FIGS. 1 and 2 respectively diagrammatically show the exemplary chair in side and rear views.

The illustrated chair has in fact been produced by modification of a commercially available chair.

The latter chair has a tubular metal frame provided as two like half frames on respectively opposite sides of the chair. Each half frame comprises a continuous unitary sequence of a backrest upright member 11, a seat support member 12 extending forwardly from the lower end of the upright member 11, a leg member 13 depending from the forward end of the seat support member

12, and a ground member 14 extending rearwardly from the lower end of the leg member 13. Each half frame also includes an armrest support member 15 projecting forwardly above the associated seat support member 12 from an intermediate position along the respective upright member 11, and an armrest 16 is connected to the upper surface of support member 15. Also, in each half frame, the ground member 14 has connected to its lower surface two ground-engaging friction pads 17 and 18 respectively located towards the front and rear of the member 14.

The two half frames are interconnected to complete the available chair by a seat 19 bridging the support members 12 and by a backrest 20 bridging the upright members 11.

When completed, the available chair is usable in a conventional manner with the friction pads 17 and 18 engaged on the ground to provide a stable normal disposition in which the centre of gravity of the chair, whether occupied or not, is disposed vertically above the space bounded by the friction pads. In this connection the ground surface is denoted in chain line and the gravitational force through the centre of gravity is represented by a vertically directed-arrow in FIG. 1.

The available chair as so far described is modified in accordance with the invention in several ways.

Each ground member 14 is extended rearwardly in upwardly inclined manner and this extension, 21, carries two wheels 22 and 23 located successively along its length respectively nearer to and further from the rear friction pad 18. These wheels are rotatable about respective axes directed transversely of the chair and the wheels project below the extension 21, with the front and rear wheels 22 and 23 respectively nearer to and further from the ground, but not in ground engagement, in the normal disposition.

Each support member 11 is provided with a handle 24 projecting rearwardly from the upper end thereof in a downwardly inclined manner.

Each half frame is strengthened by the addition of a rear leg member 25 connected between the rear of the seat support member 12 and an intermediate position along the extension 21 between the wheels 22 and 23.

Also, the two half frames are additionally interconnected by a cross member 26 joined with the former at positions along the extensions 21 adjacent to the rear wheels 23.

Use of this modification allows the chair, when occupied and in an emergency or for other reasons, to adopt a mobile disposition by rearward tilting. Such tilting first causes the front pads 17 to leave the ground, then the front wheels 22 engage the ground, whereafter the rear pads 18 leave the ground, and finally the rear wheels 23 engage the ground. The final disposition in which the chair is supported by all of the wheels is, of course, stable if the centre of gravity is disposed above the space bounded by the wheels such as indicated in FIG. 1 by dotted line representations of the ground surface and gravitational force relative to the chair in this disposition. This simple requirement is readily met by appropriate positioning of the wheels, but other considerations are important and the wheel positioning requires careful consideration if the chair is to be fully satisfactory.

One such consideration is that tilting into the stable mobile disposition should not involve an angular movement of such extent as to cause the occupant undue concern. Another consideration is that the wheels do not require such a large rearward extension of the chair relative to a conventional configuration as to cause inconvenience or render the chair markedly unconventional from a visual point of view.

Wheel positioning to satisfy these considerations involves a spacing between the wheels 22 and 23 in the range of 152–305 mm (6–12 ins) with each front wheel 22 being spaced behind its rear pad 18 by a relatively shorter distance of up to about 51 mm (2 ins). At the same time the rear wheels 23 will be elevated from the ground by a distance of up to about 76 mm (3 ins), and the front wheel by a relatively smaller distance typically of about 6 mm (0.25 in) in the normal stable disposition. This overall positioning suitably gives rise to an angular movement in the range of 10°–20°, and typically 15°–17°, between the two stable dispositions with the centre of gravity acting about 3 ins respectively forward of the rear pads and rearward of the front wheels in the normal and mobile dispositions.

Movement of the chair between its stable dispositions will normally be effected by attendant actuation from the rear. Preferably such actuation involves the application of appropriate turning force with mechanical advantage to reduce the effort required on the part of the attendant while, at the same time, any risk of rearward over-tilting from the mobile disposition should be reduced.

This objective is served in respect of actuation to the mobile disposition by the provision of the cross-member 26. This member allows the application of pedal force to effect rearward tilting and the location of the member is such that it will be spaced further from the tilting pivot, namely the rear pads 17 and then the front wheels 22, than the centre of gravity. However, when the mobile disposition is attained the cross member does not serve to apply force which acts to cause over-tilting because the member is close to or at the relevant pivot, now the rear wheels 23, and is typically located between the wheels 22 and 23.

The handles 24 will normally be used for the application of rearward and downward force to effect movement into the mobile disposition, and forward and upward force to return to the normal disposition. Eeach such use involves mechanical advantage relative to the location of the centre of gravity.

The risk of rearward over-tilting is reduced in several ways. When movement into the mobile disposition has been attained, pedal force applied to the cross member 26 will normally act against continuance of such movement. Also, in the mobile disposition, the handles preferably extend to the rear of the rear wheels 23 by a distance no greater than the corresponding forward spacing of the centre of gravity. Such distance for the handles is typically no more than about 152 mm (6 ins). In addition, the downward inclination of the handles is associated with a natural tendency to grip the highest parts thereof to apply downward force, and these parts are preferably located no more than about 51 mm (2 ins) behind the seat back members 11.

It is also to be noted that, while the stable mobile disposition is intended for conveyance of an occupant as if in a wheelchair, an intermediate mobile disposition is attained during tilting when only the front wheels are ground-engaging. This last disposition is not stable and requires effort on the part of an attendant to sustain the same, but the disposition is useful transiently to assist in steering the chair when mobile.

While the invention has been described with more particular reference to the illustrated chair, it is clearly not limited thereby. For example: castors can be used in place of at least some of the wheels, suitably at the rear to facilitate steering; the front or rear wheels can be replaced by a respective roller extending across the chair; or a single rear wheel or castor can be used. Also a chair according to the invention is open to modification in other respects: variation is possible in basic form, such as by use of a conventional four-legged structure; and other features can be added, such as a seat belt for use to afford enhanced occupant security in an emergency.

I claim:

1. A chair comprising:

a seat;

a backrest structure upstanding from said seat;

a leg structure depending from said seat;

two like pairs of front and rear friction-producing ground-engagement formations respectively mounted on each side of the chair below said leg structure; and two like pairs of front and rear ground-engaging roller elements mounted on each side of the chair on a portion of said leg structure disposed rearwardly of said formations, said elements being individually mounted such that when said formations are disposed on the ground, the lowermost portion of each said front element is located closely behind a respective one of said rear formations and just above the ground, and the lowermost portion of each said rear element is located further behind a respective one of said rear formations than each said front element and disposed above the ground a distance greater than said front elements, whereby the chair has two alternative stable dispositions when occupied, one said disposition being static with said formations disposed on the ground with the overall centre of gravity of the occupied chair being disposed vertically above the space bounded by said formations, the other of said dispositions being mobile with said elements disposed on the ground with the overall centre of gravity disposed vertically above the space bounded by said elements, said dispositions being selectable by tilting the occupied chair through a small angle about the rear formations and the front elements, respectively.

2. A chair according to claim 1 wherein each said front element is located up to about 2 ins. from said respective rear formation and about 0.25 ins. above the ground, and each said rear element is spaced about 6–12 ins. behind said respective said front element and up to about 3 ins. above the ground.

3. A chair according to claim 1 characterised in that said tilting involves an angular movement in the range of 10°–20°.

4. A chair according to claim 3 wherein said angular movement is in the range of 15°–17°.

5. A chair according to claim 1 characterised by a pair of handles projecting rearwardly from the upper portion of said back rest structure on respectively opposite sides of the chair.

6. A chair according to claim 5 characterized in that, in said mobile disposition, said handles have a downward inclination and highest parts occuring no more than about 51 mm (2 ins) behind said backrest structure.

7. A chair according to claim 5 characterised in that said assembly comprises a cross member extending transversely across the chair with its ends adjacent said rear wheels.

* * * * *